United States Patent [19]

Niimi et al.

[11] 4,244,257

[45] Jan. 13, 1981

[54] WAVE-SHAPE GENERATOR FOR ELECTRONIC MUSICAL INSTRUMENTS

[75] Inventors: Koji Niimi; Takayasu Kondo, both of Hamamatsu; Shigeo Ando, Iwati, all of Japan

[73] Assignee: Nippon Gakki Seizo Kabushiki Kaisha, Japan

[21] Appl. No.: 24,025

[22] Filed: Mar. 26, 1979

[30] Foreign Application Priority Data

Mar. 28, 1978 [JP] Japan ..... 53-36474

[51] Int. Cl.[3] ..... G10H 1/06; G10H 7/00

[52] U.S. Cl. ..... 84/1.01; 84/1.22

[58] Field of Search ..... 84/1.01, 1.03, 1.22, 84/1.24, 1.26

[56] References Cited

U.S. PATENT DOCUMENTS

| | | | |
|---|---|---|---|
| 3,823,390 | 7/1974 | Tomisawa et al. | 84/1.01 X |
| 3,844,379 | 10/1974 | Tomisawa et al. | 84/1.01 |
| 3,854,365 | 12/1974 | Tomisawa et al. | 84/1.01 |
| 4,000,675 | 1/1977 | Futamase et al. | 84/1.01 |
| 4,077,294 | 3/1978 | Hiyoshi et al. | 84/1.24 X |
| 4,119,005 | 10/1978 | Kondo et al. | 84/1.01 |
| 4,133,242 | 1/1979 | Nagai et al. | 84/1.22 X |
| 4,133,244 | 1/1979 | Hiyoshi et al. | 84/1.26 |

*Primary Examiner*—S. J. Witkowski

*Attorney, Agent, or Firm*—Ostrolenk, Faber, Gerb & Soffen

[57] ABSTRACT

A wave-shape generator advantageously used for generation of various wave-shape signals on electronic musical instruments comprises, as a substitute for multiple wave-shape memories needed in the conventional wave-shape generators, a combination of a single wave-shape memory with a weighting parameter signal generator. Modulation of the wave-shape signals via multiplication by corresponding weighting parameter signals enables formation of a wide variety of different wave-shape signals without enlargement in construction, the wave-shape signals being changeable even in a time-functional fashion too.

9 Claims, 16 Drawing Figures

WAVE-SHAPE GENERATOR FOR ELECTRONIC MUSICAL INSTRUMENTS

BACKGROUND OF THE INVENTION

The present invention relates to a wave-shape generator for electronic musical instruments, and more particularly relates to an improvement in the construction of a wave-shape generator incorporating a wave-shape memory and adapted for use on electronic musical instruments.

Wave-shape generators incorporating wave-shape memories are widely used in electronic musical instruments for generation of musical tones, generation of envelope wave-shapes, and generation of a wide variety of control wave-shapes for musical tones. Such wave-shape generators for electronic musical instruments are roughly classified into two major groups, one being successive read-out type wave-shape generators and the other being skipping read-out type wave-shape generators.

(1) Successive Read-out Type Wave-shape Generator

A successive read-out type wave-shape generator is generally comprised of a counter and a wave-shape memory coupled to the output of the counter, the counter receiving a series of variable clock pulse signals. The counter sequentially counts the variable clock pulse signals to read out count values which are applied to the wave-shape memory in the form of address signals. Upon receipt of a count value from the counter, the wave-shape memory reads out a corresponding wave sample value in order to output the same as a wave-shape signal. By properly adjusting the oscillating frequency of the variable clock pulse signals to be input to the counter, the generation cycle of the address signals to be generated by the counter can be changed thereby enabling generation of wave-shape signals having a wide variety of frequencies.

In the above-described successive read-out system, the count values of the counter are used as read-out address signals, and each of the wave sample values stored in the wave-shape memory are read out as outputs. Consequently, the number of sampling points per one cycle of a wave-shape signal outputted from the wave-shape memory is always constant and equal to the number of addresses associated with the wave-shape memory. As herein before described, the generation cycle of the address signals, i.e. the address shifting speed, generated by the counter varies in accordance with the oscillating frequency of the variable clock pulse signals to be applied to the counter. Therefore, a change in the oscillating frequency of the clock pulse signals causes a corresponding change in the number of sampling points of the wave-shape signals to be generated by the wave-shape memory per unit time interval. This causes complicated design in the subsequent processing of the wave-shape signals to be outputted from the wave-shape memory.

(2) Skipping Read-out Type Wave-shape Generator

A skipping read-out type wave-shape generator is comprised of an accumulator and a wave-shape memory coupled to the output of the accumulator, the accumulator storing frequency information (constants) signals and receiving a series of clock pulse signals. Upon receipt of the clock pulse signals, the accumulator sequentially accumulates the stored frequency information signals (each representative of a constant, respective, value) and each accumulated value is output therefrom as an address signal. Upon receipt of each address signal from the accumulator, the wave-shape memory reads out a corresponding wave sample value. The system is constructed so that one of a variety of different frequency information signals is properly singled out and input to the accumulator. Therefore, the accumulated values output from the accumulator vary from one input frequency information signal to another, thereby enabling generation of wave-shape signals having different frequencies from the wave shape memory.

In the above-described skipping read-out system, the read-out frequency information signals are sequentially accumulated in the accumulator, and the accumulated values are used as address signals for the wave-shape memory. This system is different from the above-described successive read-out system in that addresses of the wave-shape memory are sequentially nominated in a properly skipping fashion, and that the wave sample values stored in the nominated addresses are read out as wave-shape signals. Due to the fact that the accumulator accumulates the frequency information at instants determined by the clock pulse signals, this system is further different from the above-described successive read-out system in that the address signals are always output with a constant period which is equal to the generation period of the clock pulse signals, and, therefore, the number of sampling points of the wave-shape signals output per a unit time interval is also constant. Consequently, the wave-shape generator of this type is rather advantageous in that the subsequent processing of the generated wave-shape signals is simplified. With this construction, however, the skipping read-out system exhibits the drawback that, when the frequency information signals are large in value, the accumulator soon reaches its full count after a few accumulations, and, therefore, one cycle of each wave-shape signal contains a small number of sampling points.

Further both of the above-described successive and skipping read-out systems exhibit the following common drawbacks.

Once the wave-shapes to be stored in the wave-shape memories are fixed and the respective sample values are stored in the corresponding addresses of the wave-shape memories, it is impossible to alter the content of the memories. Therefore, in order to generate different types of wave-shape signals, a corresponding number of wave-shape memories have to be used. For example, assuming that a conventional wave-shape generator is used for generation of musical tone wave-shapes, one wave-shape memory generates musical tone wave-shapes of only one tone color, i.e. piano tones. In order to obtain musical tone wave-shapes of different tone colors, it is necessary to use a corresponding number of additional wave-shape memories. This naturally results in a large construction and a high production cost of the wave-shape generators for electronic musical instruments.

In both systems, the wave-shape signals read out from the wave-shape memories take the form of repetition of similar basic wave-shapes. Thus, it is impossible with the conventional construction to obtain wave-shape signals whose wave-shapes vary time-functionally. This inconvenience becomes particularly recognizable when, for example, a conventional wave-shape generator is used for genration of musical tone wave-shapes. In the case of natural musical instruments, their musical tones always change in tone color, i.e. wave-shape, from the beginning to the end of the tone generation, thereby providing the musical tones with a colorful acoustic effect. As hereinbefore described, musical tone wave-shapes generated on the conventional wave-shape generator are given in the form of repetition of similar basic wave-shapes. Consequently, musical tones generated on electronic musical instruments equipped with the conventional wave-shape generators are quite trivial and tedious in their acoustic effect when compared with those on natural instruments.

SUMMARY OF THE INVENTION

It is one object of the present invention to provide a wave-shape generator for electronic musical instruments which generates a wide variety of wave-shape signals without enlarging the construction of the generator.

It is another object of the present invention to provide a wave-shape generator for electronic musical instruments which generates wave-shape signals which vary as a function of time.

In accordance with the basic concept of the present invention, wave-shape signals generated by a wave-shape memory are multiplied by separately generated weighting parameter signals.

DESCRIPTION OF THE PREFERRED EMBODIMENTS

Figure 1:
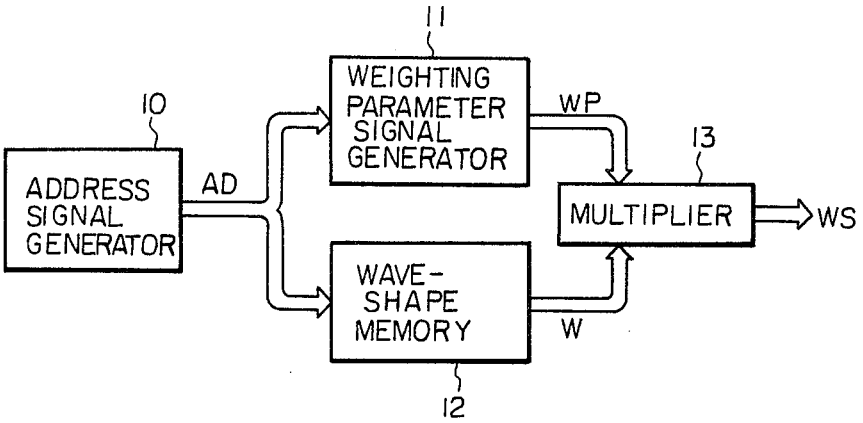
FIG. 1 is a block diagram showing the basic construction of the wave-shape generator for electronic musical instruments in accordance with the present invention.
Figure 2A:
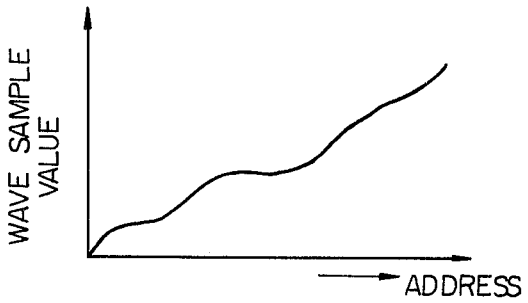
FIG. 2A is a graphical representation of one example of the wave-shape signals stored in the parameter signal generator used in the wave-shape generator shown in FIG. 1.
Figure 2B:
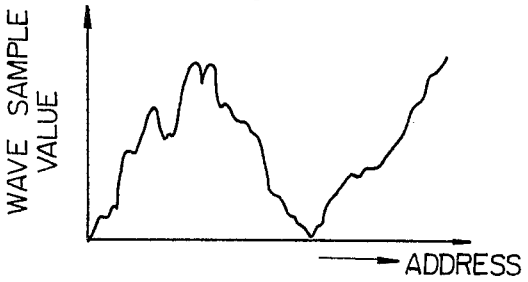
FIG. 2B is a graphical representation of one example of the wave-shape signals stored in the wave-shape memory used in the wave-shape generator shown in FIG. 1.

FIG. 1 depicts the basic construction of the wave-shape generator in accordance with the present invention. The output of an address signal generator 10 is coupled in parallel to the address input of a weighting parameter signal generator 11 and a wave-shape memory 12, respectively. The output of the weighting parameter signal generator 11 is coupled to a first input terminal of a multiplier 13 whereas the output of the wave-shape memory 12 is coupled to a second input terminal of the multiplier 13. The weighting parameter signal generator 11 includes a number of memories, e.g. read-only memories, each of which stores, for example, a wave-shape signal such as shown in FIG. 2A (in the form of a plurality of sample values). The wave-shape memory 12 is also includes a number of memories, e.g. read-only memories, each of which stores, for example, a wave-shape signal such as shown in FIG. 2B also in the form of a plurality of sample values. The address signal generator 10 used herein corresponds to the above-described counter, which receives the variable clock pulse signals, used in the successive read-out system and the accumulator, which stores the frequency information signals, used in the skipping read-out system.

Figure 3:
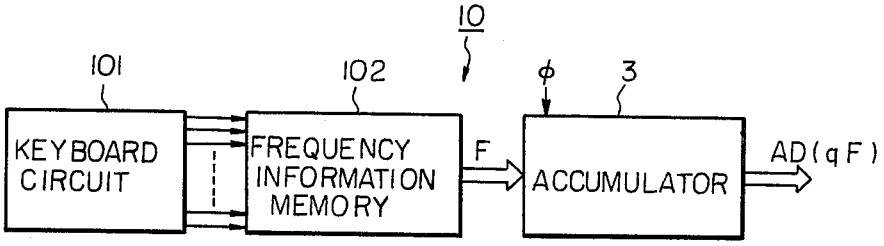
FIG. 3 is a block diagram showing one example of the construction of the address signal generator used in the wave-shape generator shown in FIG. 1.

One practical example of the above-described address signal generator 10 is shown in detail in FIG. 3, in which an address signal generator for a skipping read-out system is used and the wave-shape generator in accordance with the present invention is used for generation of musical tones. A keyboard circuit 101 outputs a logic "1" on one of its output lines when a corresponding key is depressed on the keyboard of the electronic musical instrument to which the wave-shape generator of the present invention is applied. A single note selection circuit is incorporated in the keyboard circuit 101 so that, when two or more keys are concurrently depressed, a single note key is selected for tone generation. One typical example of such a single note selection circuit is disclosed in U.S. Pat. No. 3,981,217 to Oya issued on Sept. 21, 1976.

The output lines of the keyboard circuit 101 are all coupled to the input of a frequency information memory 102 which stores a number of frequency information signals F corresponding to respective keys on the keyboard in order to determine tonal pitches, i.e. frequencies, of musical tones to be generated by the musical instrument. Thus, when a certain key is depressed on the keyboard, a corresponding frequency information signal F is read out from the frequency information memory 102. The output of the frequency information memory 102 is coupled to the input of an accumulator 3 which receives a series of clock pulse signals $\phi$. Upon receipt of the clock pulse signals $\phi$, the accumulator 3 sequentially accumulates the frequency information signals F generated by the frequency information memory 102 and sequentially outputs accumulated values qF ($q=1, 2, 3 - - -$) as address signals AD.

In the wave-shape generator shown in FIG. 1, read-out address signals AD generated by the address signal generator 10 are applied to the weighting parameter signal generator 11 and the wave-shape memory 12, whereby both the weighting parameter signal generator 11 and the wave-shape generator 12 are addressed by a common address signal AD. Each weighting parameter signal WP from the weighting parameter signal generator 11 and each corresponding wave-shape signal W are applied to the multiplier 13 and multiplied by each other in order to form a new wave-shape signal WS which is preferably further processed.

Figure 4:
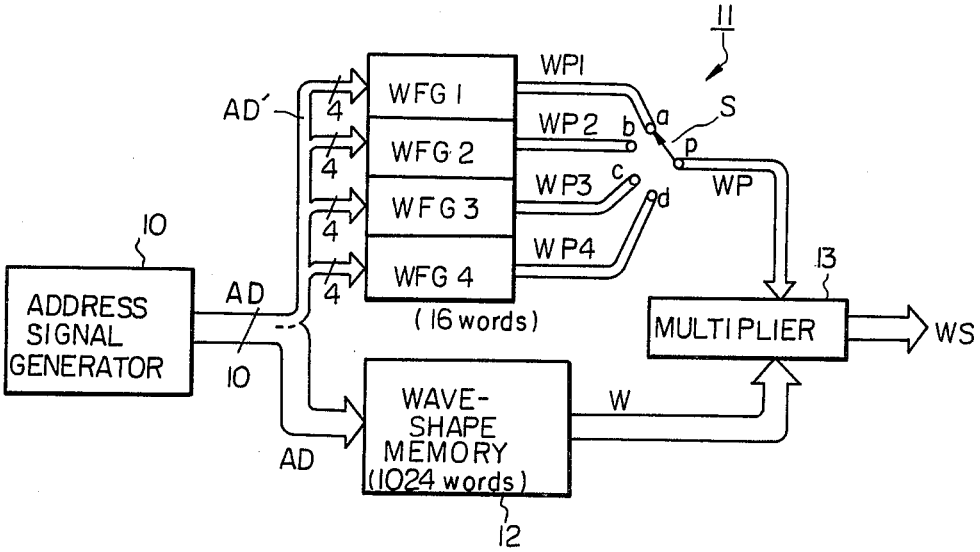
FIG. 4 is a block diagram showing the construction of a first embodiment of the wave-shape generator of the present invention.
Figure 5A:
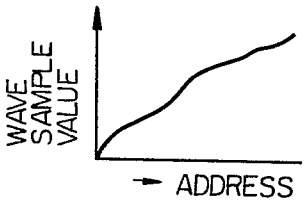
FIGS. 5A to 5D are graphical representations of one example of the wave-shape signals stored in the read-only memories of the weighting parameter signal generator used in the wave-shape generator shown in FIG. 4.
Figure 5B:
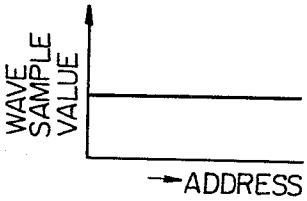
Figure 5C:
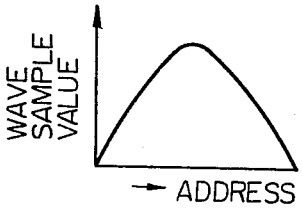
Figure 5D:
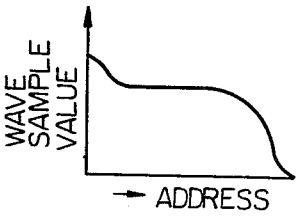

The first embodiment of the wave-shape generator in accordance with the present invention is shown in FIG. 4, in which the weighting parameter signal generator 11 contains four sets of read-only memories WFG 1 to WFG 4, the outputs of these memories being coupled to the first input terminal of the multiplier 13. The address signal generator 10 outputs address signals AD of ten bits which are directly applied to the wave-shape memory 12. Further, signals AD', defined by the highest four bits of the respective address signals AD, are applied to the read-only memories WFG 1 to WFG 4 (different in stored shapes) of the weighting parameter signal generator 11.

The wave-shape memory 12 includes a read-only memory having a storage capacity of 1024 words whereas the read-only memories WFG 1 to WFG 4 of the weighting parameter signal generator 11 are read-only memories having a storage capacity of 16 words, respectively. The wave-shape signal shown in FIG. 2B is stored in the wave-shape memory 12 whereas wave-shape signals shown in FIGS. 5A to 5D are stored in the read-only memories WFG 1 to WFG 4 of the weighting parameter signal generator 11.

Read-out address signals AD sequentially generated by the address signal generator 10 are applied to the weighting parameter signal generator 11 and the wave-shape memory 12 and, upon receipt of the above-described address signals AD' (4 bits), the weighting parameter signal generator 11 generates, as the weighting parameter signals WP, the wave sample values stored in its nominated address locations. Similarly, upon receipt of the read-out address signals AD, the wave-shape memory 12 outputs, as the wave-shape signals W, the wave sample values stored in its nominated address locations. The weighting parameter signals WP and the wave-shape signals W are multiplied by the multiplier 13 in order to form the new wave-shape signals WS.

In accordance with the above-described first embodiment of the wave-shape generator of the present invention, the wave-shape signals stored in the respective read-only memories WFG 1 to WFG 4 are read out once (one cycle) as the weighting parameter signals WP 1 to WP 4 during the same time interval that the wave-shape signals stored in the wave-shape memory 12 are read out once (one cycle) as the wave-shape signals W. In other words, the period for outputting one cycle of wave-shape signal W is tantamount to the period for outputting one cycle of weighting parameter signals WP.

The output of the read-only memories WFG 1 to WFG 4 are coupled to respective fixed contacts a to d of a switch S. A movable contact p of the switch S is coupled to the first input terminal of the multiplier 13.

When the movable contact p of the switch is registered at any one of the fixed contacts a to d, a corresponding one of the weighting parameter signals WP 1 to WP 4 is selectively applied to the multiplier 13 for multiplication with a corresponding wave-shape signal W concurrently read out from the wave-shape memory 12. As hereinbefore described, one cycle of weighting parameter signals WP 1 to WP 4 are output from the read-only memories WFG 1 to WFG 4 during the period in which one cycle of wave-shape signal W is read out from the wave-shape memory 12. Consequently, the wave-shape signals W stored in the wave-shape memory 12 are divided into 16 groups each of which contains 64 words and wave-shape signals W output from a common group are multiplied by a common value of weighting parameter signals WP 1 to WP 4. Particularly, wave sample values (wave-shape signals W) stored in the wave-shape memory 12 are each divided into 16 parts by the weighting parameter signals WP 1 to WP 4 and subjected to amplitude modulation. In accordance with the above-described first embodiment of the present invention, different weighting parameter signals WP 1 to WP 4 are selected as desired by adjusting the registration of the movable contact p in the switch S, thereby enabling generation of a wide variety of different wave-shape signals WS without the need to provide a plurality of wave-shape memories.

In the outstanding embodiment, it is necessary to use only four sets of additional read-only memories having storage capacities of 16 words. In addition, since the weighting parameter signals WP 1 to WP 4 are used only to modulate the wave-shape signals W, high accuracy is not required for the weighting parameter signals WP 1 to WP 4 which are quite different from the wave-shape signals W. Consequently, only a small number of bits are required for one word of the read-only memories, the number of bits being equal to that of the weighting parameter signals WP 1 to WP 4. Thus, the construction of the wave-shape generator need not be enlarged through same is capable of generating a wide variety of different wave-shape signals.

Figure 6:
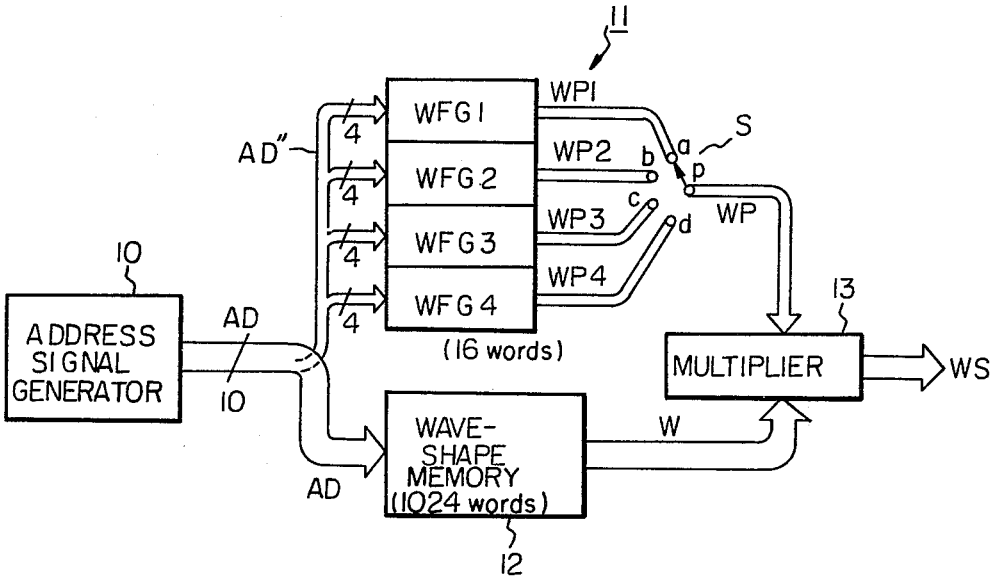
FIG. 6 is a block diagram showing the construction of a second embodiment of the wave-shape generator of the present invention.

The second embodiment of the wave-shape generator in accordance with the present invention is shown in FIG. 6, in which elements substantially common in construction and operation to those used in the first embodiments are designated with common reference symbols.

In the case of the first embodiment, the highest four bits signals AD' of the 10 bits address signals AD generated by the address signal generator 10 are applied to the weighting parameter signal generator 11. The second embodiment is different from the first embodiment in that the lowest four fits out of the 10 bit address signals AD generated by the address signal generator 10 are applied to the read-only memories WFG 1 to WFG 4 of the weighting parameter signal generator 11 as signals AD". The structure and operation of the remaining elements of FIG. 6 are substantially similar to that of FIG. 4.

Therefore, wave-shape signals stored in the read-only memories WFG 1 to WFG 4 are output 64 times as the weighting parameter signals WP 1 to WP 4 during the time interval that the wave-shape signals stored in the wave-shape memory 12 of 1024 words are read out a single time as the wave-shape signals W by the above-described address signals AD. By registering the movable contact p at any one of the fixed contacts a to d in the switch S, one of the outputted weighting parameter signals WP 1 to WP 4 is singled out in order to be applied to the first input terminal of the multiplier 13, and multiplied by a corresponding wave-shape signal W read out from the wave-shape memory 12 to form a new wave-shape signal WS. Thus, one cycle of the wave-shape signal W read out from the wave-shape memory 12 is substantially divided into 64 groups in each of which one cycle of the four weighting parameter signals WP 1 to WP 4 read out from the read-only memories WFG 1 to WFG 4 are subjected to multiplication.

In accordance with the second embodiment of the present invention, different weighting parameter signals WP 1 to WP 4 can be freely selected as desired by adjusting the registration mode of the movable contact p in the switch S, thereby enabling generation of a wide variety of different wave-shape signals WS without using a plurality of wave-shape memories.

In this case, it is necessary to provide only four sets of read-only memories of 16 words. In addition, since the weighting parameter signals WP 1 to WP 4 are used for modulation of the wave-shape signals W only, high accuracy is not required for the weighting parameter signals WP 1 to WP 4 which are quite different from the wave-shape signals W. Therefore, only small number of bits are required for one word of the read-only memories, thereby successfully avoiding enlarged construction of the wave-shape generator.

Figure 7:
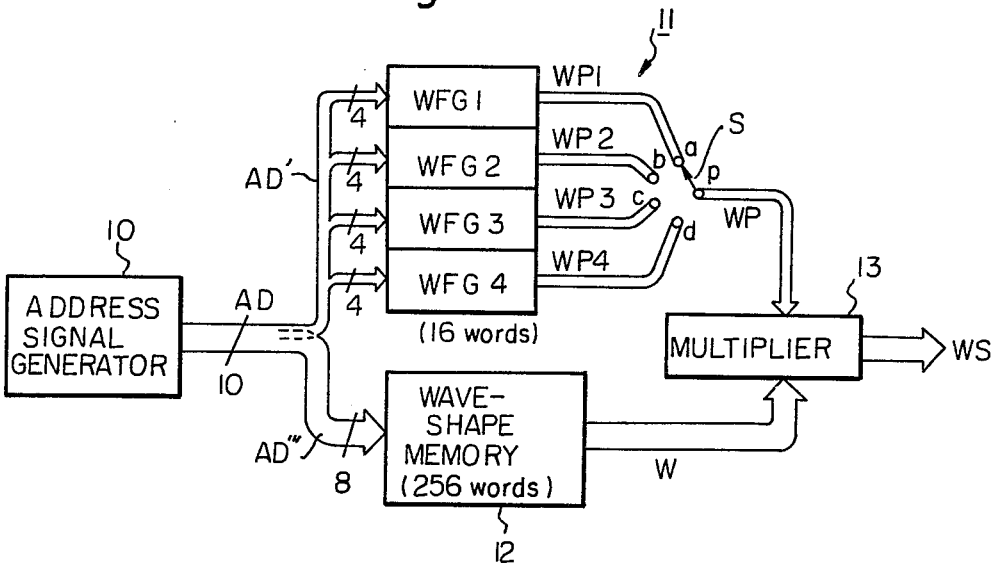
FIG. 7 is a block diagram for showing the construction of the third embodiment of the wave-shape generator of the present invention.

The third embodiment of the wave-shape generator in accordance with the present invention is shown in FIG. 7, in which elements substantially common in construction and operation to those used in the foregoing embodiments are designated with common reference symbols. The construction and operation of this embodiment are basically similar to those of the first and second embodiments with the following exception. Like the foregoing embodiments, the address signal generator 10 outputs read-out address signals AD of 10 bits and the wave-shape memory 12 is made up of read-only memories of 256 words and stores a wave-shape signal such as shown in FIG. 2B. The lowest 8 bits of the read-out address signals AD generated by the address signal generator 10 are applied to the wave-shape memory 12 as signals AD'''. The weighting parameter signal generator 11 is made up of four sets of read-only memories WFG 1 to WFG 4 of 16 words, and stores wave-shape signals such as shown in FIGS. 5A to 5D. The highest 4 bits signals AD' out of the read-out address signals AD generated by the address signal generator 10 are applied to the above-described read-only memories WFG 1 to WFG 4.

In accordance with the third embodiment of the present invention, the highest 4 bits of the read-out address signals AD of 10 bits outputted from the address signal generator 10 are applied to the read-only memories WFG 1 to WFG 4 of the weighting parameter signal generator 11 as signals AD' whereas the lowest 8 bits of the read-out address signals AD are applied to the wave-shape memory 12 as signals AD'''. Consequently, one cycle of weighting parameter signals WP 1 to WP 4 are read out from the read-only memories WFG 1 to WFG 4 of the weighting parameter signal generator 11 during the interval in which four cycles of wave-shape signals W are read out from the wave-shape memory 12. By registering the movable contact p at any one of the four fixed contact a to d in the switch, one of the generated weighting parameter signals WP 1 to WP 4 is input to the first input terminal of the multiplier 13. The weighting parameter signals WP 1 to WP 4 so inputted are each multiplied by a corresponding wave-shape signal W applied to the second terminal of the multiplier 13 in order to form a new wave-shape signal WS. One cycle of this new wave-shape signal WS is formed of four cycles of the wave-shape signals, W, i.e. one cycle of the weighting parameter signals WP 1 to WP 4, generated by the wave-shape memory 12.

In accordance with the third embodiment of the present invention, different weighting parameter signals WP 1 to WP 4 can be freely selected as desired by adjusting the registration mode of the movable contact p in the switch S, thereby enabling generation of a wide variety of different wave-shape signals WS without using a plurality of wave-shape memories. In this case, only four sets of read-only memories of 16 words are used. In addition, no high accuracy is required for the weighting parameter signals WP 1 to WP 4 since they are used for modulation of the wave-shape signals W which generally require high accuracy. Thus, only small number of bits are necessary for one word of the read-only memories, thereby successfully avoiding enlarged construction of the wave-shape generator.

In the construction of the first to third embodiments, the switch S is arranged on the output side of the read-only memories WFG 1 to WFG 4 for optional selection of the weighting parameter signals WP 1 to WP 4. It is also possible, however, to arrange the switch S on the input side of the read-only memories WFG 1 to WFG 4 for optional allotment of the address signals AD, AD' or AD''.

Figure 8:
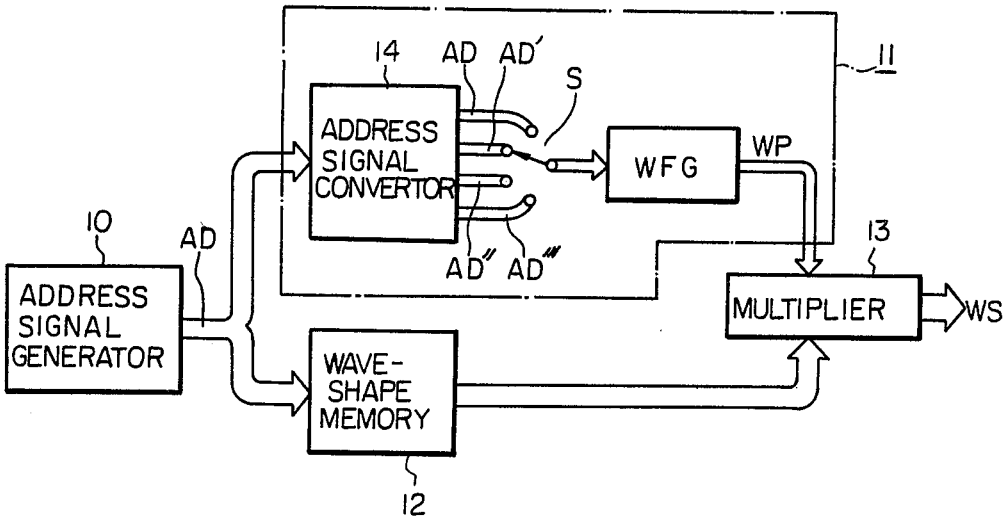
FIG. 8 is a block diagram showing the construction of a fourth embodiment of the wave-shape generator of the present invention.

The fourth embodiment of the wave-shape generator in accordance with the present invention is shown in FIG. 8, in which elements substantially common in construction and operation to those used in the foregoing embodiments are designated with common reference symbols. This embodiment is different from the foregoing embodiments in that the weighting parameter signal generator 11 includes an address signal convertor 14, a switch S and a read-only memory WFG. Upon receipt of a read-out address signal AD generated by the address signal generator 10, the address signal convertor 14 generates four corresponding signals, i.e. the read-out address signal AD itself, the highest 4 bits signal AD' thereof, the lowest 4 bits signal AD'' thereof and the lowest 8 bits signal AD''' thereof. The four signals AD, AD', AD'' and AD''' are applied to four fixed contacts a, b, c and d of the switch S, respectively. By registering the movable contact p with one of the four fixed contacts a to d, only one of the above-described signals AD to AD''' is applied to the read-only memory WFG. Thus, different weighting parameter signals WP are generated by the read-only memory WFG depending on the position of the movable contact p in the switch S. The weighting parameter signals WP are each multiplied by the multiplier 13 with a corresponding wave-shape signal W generated by the wave-shape memory 12 for formation of a new modulated wave-shape signal WS.

In accordance with the fourth embodiment of the present invention, it is possible to optionally select different weighting parameter signals WP by adequately adjusting the registration mode of the switch. Thus, a wide variety of modulated wave-shape signals WS can be obtained without using a plurality of wave-shape memories. In addition, this fourth embodiment requires provision of one read-only memory WFG only, thereby greatly minimizing the total size of the wave-shape generator.

Figure 9:
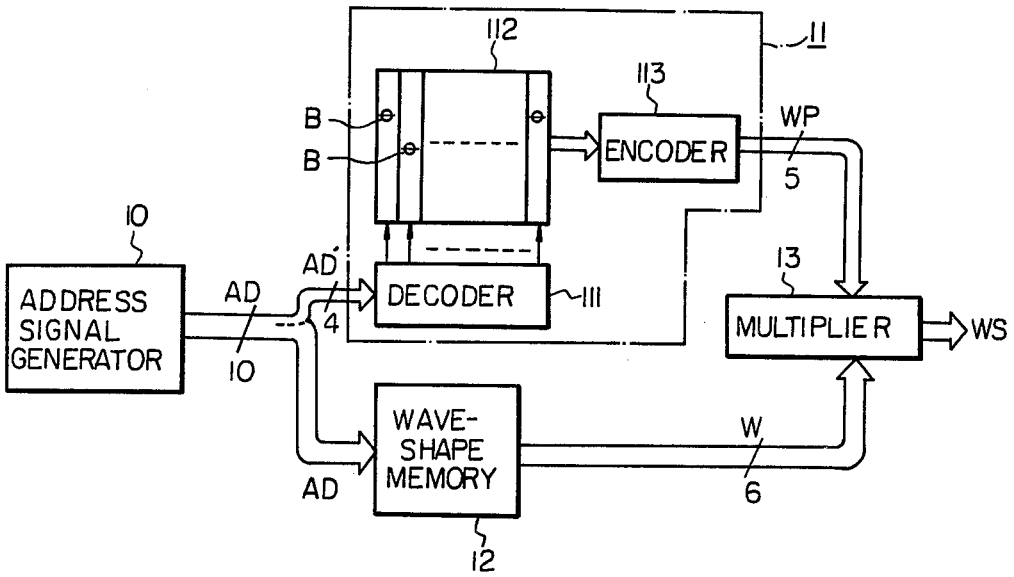
FIG. 9 is a block diagram showing the construction of a fifth embodiment of the wave-shape generator of the present invention.

The fifth embodiment of the wave-shape generator in accordance with the present invention is shown in FIG. 9, in which elements substantially common in construction and operation to those used in the foregoing embodiments are designated with common reference symbols. In the case of this embodiment, the weighting parameter signal generator 11 is comprised of a decoder 111, a drawbar type switch 112 and an encoder 113. The highest 4 bits of the 10 bits address signals AD generated by the address signal generator 10 are applied to the decoder 111 of the weighting parameter signal generator 11 as signals AD' whereas the 10 bit address signals AD is applied to the wave-shape memory 12.

Figure 10:
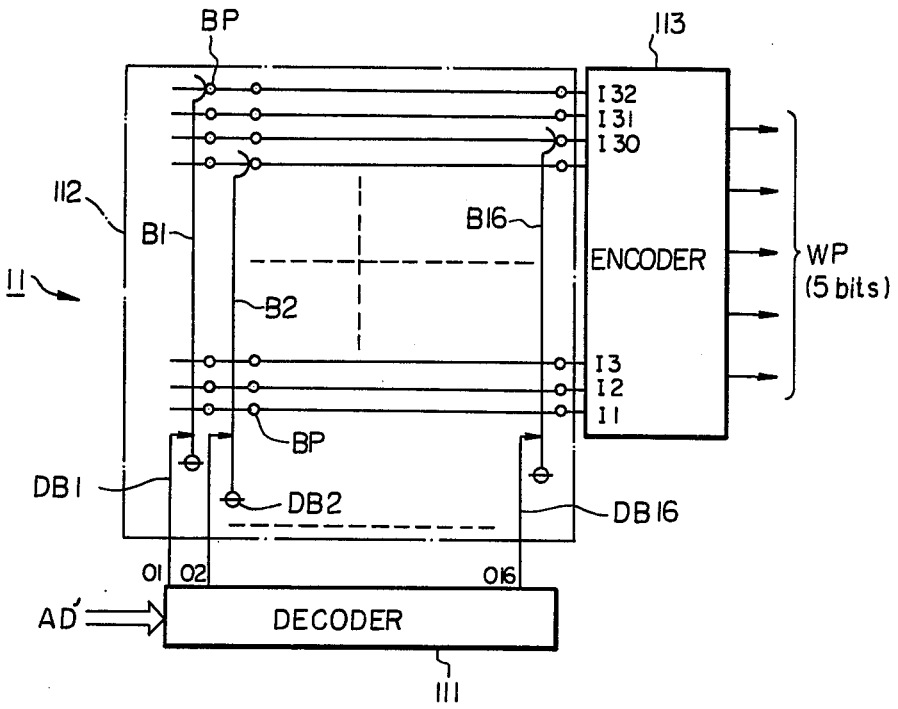
FIG. 10 is a block diagram showing the detailed construction of one example of the weighting parameter signal generator used in the wave-shape generator shown in FIG. 9.

As shown in detail in FIG. 10, the decoder 111 sequentially decodes the highest 4 bits (signal AD') of the address signals AD in order to output the decoded results on its sixteen output lines 01 to 016 which are coupled to sliding leaves B1 to B16 of the drawbar type switch 112, respectively. The drawbar type switch 112 is so constructed that, by sliding respective associated drawbars DB 1 to DB 16, the sliding leafs B 1 to B 16 are each brought into contact with one of contacts BP provided on 32 sets of input lines I 1 to I 32 of the encoder 113. Therefore, decoded signals of the address signals AD' generated by the decoder 111 are selectively and sequentially passed to the encoder 113 depending on the position of the drawbars DB 1 to DB 16. The encoder 113 encodes signals applied thereto via the input lines I 1 to I 32 in order to output the encoded results as 5 bit weighting parameter signals WP of 5 bits. Thus, a wide variety of different weighting parameter signals WP can be generated by optionally adjusting the position of the drawbars DB 1 to DB 12 in the drawbar type switch 112. The multiplier 13 carries out multiplication of the weighting parameter WP received at its first input terminal with the wave-shape signals W received at its second input terminal in order to output new modulated wave-shape signals WS.

In the above-described embodiment, the highest four bits of the read-out address signals AD are applied to the decoder 111 as signals AD' whereas the 10 bit read-out address signals AD are applied to the wave-shape memory 12. Alternatively, it is possible to select appropriate bits from the 10 bit read-out address signals AD and to apply these bits to the decoder 111 and to the wave-shape memory 112. Further, the read-out address signals AD may have a different number of bits.

Figure 11:
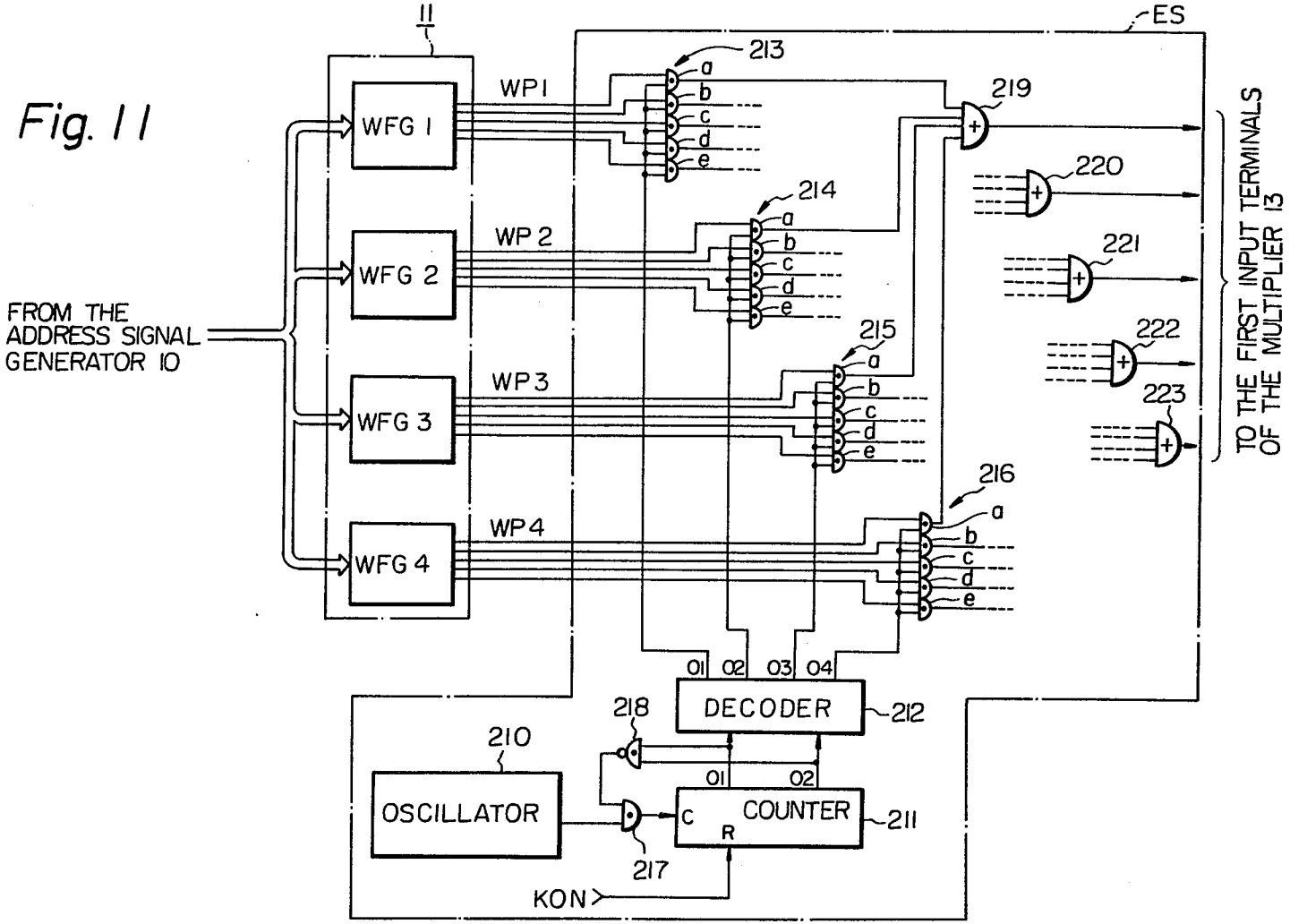
FIG. 11 is a block diagram showing the construction of one example of the electronic switch used in the present invention.

The switch S used in the foregoing embodiments may be replaced by an electronic switch whose setting can be changed sequentially, thereby enabling generation of modulated wave-shape signals WS whose wave-shapes vary as a function of time. One example of such an electronic switch is shown in FIG. 11.

In the illustrated construction, an electronic switch ES includes an oscillator 210, a counter 211, a decoder 212, AND-gate groups 213 to 216 each having five AND gates a to e, and an AND-gate 217, a NAND-gate 218 and OR-gates 219 to 223. Here, the AND-gate groups 213 to 216 and the OR-gates 219 to 223 form contacts of the electronic switch ES whereas the oscillator 210, the counter 211, the decoder 212, the AND-gate 217 and the NAND-gate 218 form a control position of the electronic switch ES.

The output of the oscillator 210 is coupled to the second input terminal of the AND-gate 217 whose output is coupled to the count input terminal C of the counter 211. Two output lines 01 and 02 of the counter 211 are coupled, on one hand, to the input of the decoder 212 and, on the other hand, to the input of the NAND-gate 218. The output of the NAND-gate 218 is coupled to the first input terminal of the AND-gate 217 whereas four output lines 01 to 04 of the decoder 212 are coupled to the second input terminals of the corresponding respective AND-gates a to e. The first input terminals of the AND-gates a to e in the AND-gate groups 213 to 216 receive 5 bit weighting parameter signals WP1 to WP4 generated by the respective read-only memories WFG1 to WFG4 in the weighting parameter signal generator 11.

The outputs of the AND-gates a in the respective AND-gate groups 213 to 216 are coupled to the input of the OR-gate 219. Though not shown in the drawing, the outputs of the AND-gates b in the respective AND-gate groups 213 to 216 are similarly coupled to the input of the OR-gate 220. The outputs of the AND-gates c in the respective AND-gate groups 213 to 216 are coupled to the input of the OR-gate 221, the outputs of the AND-gates d to the input of the OR-gate 222, and the output of the AND-gates e to the input of the OR-gate 223, respectively. The outputs of the above-described OR-gates 219 to 223 are coupled to the first input terminal of the multiplier 13.

The reset terminal R of the counter 211 receives key-on signals KON which take the form of pulse signals generated only when any key is depressed in the keyboard of the electronic musical instrument. The oscillation cycle of the oscillator 210 should be designed to be longer than the output cycle of the read-out address signals AD by the address signal generator 10.

Operation of the wave-shape generator equipped with the above described electronic switch ES is as follows.

When a certain key is depressed on the keyboard, a key-on signal KON is generated and applied to the counter 211. Upon receipt of this key-on signal KON, the contents of the counter 211 are reset to the logic "0". Logic "0" values are then applied to decodes 212 via output lines 01 and 02 of the counter 211. A logic value "1" is applied to the output line 01 of the decoder 212 and applied to the second input terminals of the AND-gates a to e in the AND-gate group 213. As a result, respective bits of the weighting parameter signal WP1 generated by the read-only memory WFG1 of the weighting parameter signal generator 11 are applied to the OR-gates 219 to 223 via the AND-gate group 213. The respective bits of the weighting parameter signal WP1 are then applied to the first input terminal of the multiplier 13 for multiplication by a corresponding wave-shape signal W from the wave-shape memory 12 for formation of a new modulated wave-shape WS.

As the oscillator 210 generates the first clock pulse signal, the following operation is initiated. The logic "0" on the output lines 01 and 02 from counter 211 are passed to the NAND-gate 218 which in turn generates a logic "1". As this logic "1" is applied to the first input terminal of the AND-gate 217, the above-described first clock pulse signal from the oscillator 210 is applied to the count input terminal C of the counter 211 via the AND-gate 217. Thus, the count value of the counter 211 goes to "1". Upon receipt of the count values "1" on the two output lines 01 and 02 from the counter 211, the decoder 112 generates a logic value "1" on its second output line 02. As in the above-described case in which the count value of the counter 211 goes to "0", the weighting parameter signal WP2 generated by the read-only memory WFG2 in the weighting parameter signal generator 11 is applied to the first input terminal of the multiplier 13 via the AND-gate group 214 and the OR-gates 219 to 223. Consequently, the multiplier 13 generates a new modulated wave-shape signal WS which is different in wave-shape from that generated when the count value of the counter 211 assumes "0" state.

As the oscillator 210 generates the second clock pulse signal, the count value of the counter 211 goes to "2" and, upon receipt of this count value, the decoder 212 generates a logic "1" on its third output line 03. Consequently, the weighting parameter signal WP3 read out from the read-only memory WFG3 of the weighting parameter signal generator 11 is applied to the first input terminal of the multiplier 13 via the AND-gate group 215 and the OR-gates 219 to 223 for formation of a new modulated wave-shape signal WS.

As the oscillator 210 generates the third clock pulse signal, the counter 211 generates logic "1" on its two output lines 01 and 02 which are passed to the NAND-gate 218 and the decoder 212. Upon receipt of this logic value, the decoder 212 outputs a logic "1" on its fourth output line 04. As a result, the weighting parameter signal WP4 generated by the read-only memory WFG4 of the weighting parameter signal generator 11 is applied to the first input terminal of the multiplier 13 via the AND-gate group 216 and the OR-gates 219 to 223 for formation of a new modulated wave-shape signal.

As hereinbefore described, the logic "1" applied to both output lines 01 and 12 of the counter 211 are passed to the NAND-gate 218 and the NAND-gate 218 generates a logic "0" in accordance with the logical function of NAND-gate 218. As a result, an AND condition is not established at the AND-gate 217 and the clock pulse signals generated by oscillator 210 are not passed to the count input terminal of the counter 211 until the key-on signal KON is again applied to the reset terminal R of the counter 211.

As is clear from the foregoing description, use of the electronic switch ES shown in FIG. 11 allows a wide variety of time-functional changes in selection of the weighting parameter signals WP (WP1 to WP4), thereby enabling generation of the new modulated wave-shape signals WS whose wave-shapes vary as a function of time.

In the embodiment illustrated in FIG. 11, the weighting parameter signal generator 11 includes four sets of read-only memories WFG1 to WFG4. However, the number of the read-only memories can be changed as desired in practice. In such cases, the full count value for the counter 211, the capacity of the decoder 212 and the number of the AND-gate groups are modified accordingly. Further, the electronic switch ES is arranged on the output side of the read-only memories WFG1 to WFG4 in the construction shown in FIG. 11 for control of the weighting parameter signals WP1 to WP4. It is also possible to arrange the electronic switch ES between the address signal generator 10 and the read-only memories WFG1 to WFG4, thereby controlling the address signals AD from the address signal generator 10. Further, the switch S used in the fourth embodiment in FIG. 8 may be replaced by the above-described electronic switch ES.

Application of the wave-shape generator in accordance with the present invention is not limited to generation of musical tone wave-shapes only. It is applicable to generation of envelope wave-shapes and various control wave-shapes. When the present invention is to be used for generation of envelope wave-shapes, an address signal generator 10 such as shown in FIG. 12 is advantageously used.

Figure 12:
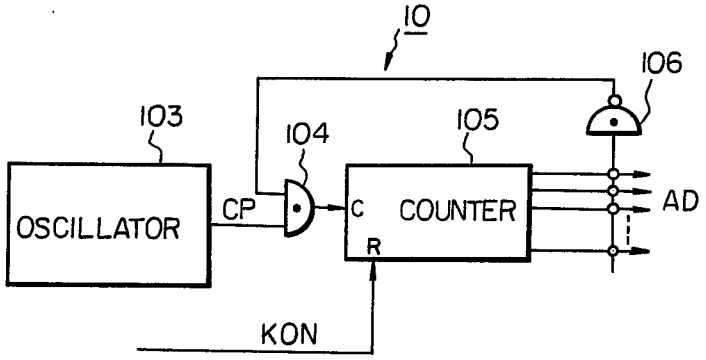
FIG. 12 is a block diagram showing the construction of one example of the address signal generator used in the present invention.

More specifically, the address signal generator 10 shown in FIG. 12 is used for a wave-shape generator of the successive read-out type. The output of an oscillator 103 is coupled to the second input terminal of an AND-gate 104 whose output is in turn coupled to the count input terminal C of a counter 105. The reset terminal R of the counter 105 receives key-on signals KON each of which indicates depression of a certain key on the keyboard of the musical instrument. The output lines from the counter 105 are coupled to the input of a NAND-gate 106 whose output is in turn coupled to the first input terminal of the above-described AND-gate 104. As hereinbefore described, each key-on signal KON is generated, in the form of a pulse signal, by the keyboard circuit (not shown) when a certain key is depressed on the keyboard of the musical instrument.

Upon receipt of each key-on signal KON, the contents of the counter 105 are all reset to "0". As a consequence, a NAND state is established at the NAND-gate 106 which in turn generates a logic "1". Upon receipt of this logic "1", the AND gate 104 allows passage of clock pulse signals CP sequentially generated by the oscillator 103 and the clock pulse signals CP are thus applied to the count input terminal C of the counter 105. The counter 105 sequentially counts the clock pulse signals in order to sequentially output count values as the read-out address signals AD. When the counter 105 has counted its full count value, logic "1" appears on each of its output lines and the NAND-gate 106 generates a logic "0". An AND state is no longer established at the AND-gate 104 and no clock pulse signal CP from the oscillator 103 is allowed to reach the count input terminal C of the counter 105. Consequently, the counter 105 ceases its counting operation and no address signal AD is generated.

As is clear from the foregoing description, employment of the present invention assures generation of a wide variety of different modulated wave-shape signals without enlarging size of the wave-shape generator. It is also possible in accordance with the present invention to generate wave-shape signals whose wave-shapes vary time-functionally.

We claim:

1. A wave-shape generator for electronic musical instruments having a plurality of keys, comprising:

address signal generator means for generating an address signal having a value which progresses at a rate corresponding to a depressed one of said keys, the rate of progression of the value of said address signal being different for each said key;

wave-shape memory means storing a wave-shape in the form of a plurality of sample values, said wave-shape means being coupled to the output of said address signal generator and receiving said address signal, said wave-shape memory means generating, upon receipt of said address signal, a wave-shape signal whose shape is determined by said stored wave-shape and whose period is determined by said rate;

weighting parameter signal generator means coupled to the output of said address signal generator and receiving said address signal, said weighting parameter signal generator means generating, upon receipt of said address signal, a weighting parameter signal whose magnitude changes during said period of said wave-shape signal as a function of said address signal, the period of said weighting parameter signal being determined by said rate of progression of said value of said address signal; and a multiplier coupled to the output coupled to the output of said weighting parameter signal generator and said wave-shape memory for multiplying said weighting parameter signal with said wave-shape signal and generating a corresponding modulated wave-shape signal representing a new wave-shape different in shape from said wave-shape represented by said wave-shape sample values stored in said wave-shape memory.

2. A wave-shape generator as claimed in claim 1 in which said weighting parameter signal generator includes:

a plurality of read-only memories each storing a different wave-shape signal; and a switch movable between an equal plurality of positions for causing a selected one of said different wave-shape signals to be applied to said multiplier as a function of the position of said switch.

3. A wave-shape generator as claimed in claim 1 in which said weighting parameter signal generator includes:

a plurality of read-only memories each storing a different wave-shape signal;

a switch switchable between an equal plurality of positions for causing a selected one of said different wave-shape signals to be applied to said multiplier as said weighting parameter signal and as a function of the position of said switch; and a control circuit automatically changing the position of said switch as a function of time.

4. A wave-shape generator as claimed in claim 2 or 3 in which said switch is coupled between said read-only memories and said multiplier.

5. A wave-shape generator as claimed in claim 1 in which said weighting parameter signal generator includes:

a decoder coupled to the output of said address signal generator and for decoding at least a part of each said address signal;

an encoder coupled to the output of said decoder; and a drawbar type switch coupled between said decoder and said encoder and for connecting selected input terminals of said encoder to selected output terminals of said decoder.

6. A wave-shape generator as claimed in claim 1 in which only a part of each said address signal generated by said address signal generator is applied to said weighting parameter signal generator.

7. A wave-shape generator as claimed in claim 1 in which each said address signal includes n bits, n being an integer greater than 1, and wherein said weighting parameter signal generator includes:

a circuit which, upon receipt of each said address signal, generates a plurality of new address signals, each of said new address signals defined by different ones of said n bits of said address signal;

a switch for optionally selecting any one of said new address signals; and a read-only memory storing said weighting parameter signal and coupled to the output of said switch, said read-only memory outputting, upon receipt of said selected one of said new address signals, a corresponding weighting parameter signal.

8. A wave-shape generator as claimed in claim 3, in which said switch is an electronic switch including:

n OR gates, the output of each of said OR gates defining a different bit of said weighting parameter signal, n being an integer greater than 1;

m groups of n AND-gates, each AND gate in a respective group of AND-gates being coupled to the output of an associated read-only memory, m being an integer greater than 1 and equal to the number of said plurality of read-only memories, each group of AND-gates being associated with a different one of said plurality of read-only memories, each AND-gate in a group of AND-gates being coupled to a different said OR-gate; and means for sequentially enabling each of said AND-gate groups in accordance with a predetermined sequence such that only one said AND-gate group is enabled at any time.

9. A wave-shape generator as claimed in claim 8, wherein said sequentially enabling means comprises:

an oscillator;

a decoder adapted to enable that AND-gate group selected by an input signal applied to said decoder;

a counter whose output defines said input signal, said counter including a count input terminal which receives the output of said oscillator and a reset input signal which receives a key on signal; and gate means for applying the output of said oscillator to said count input terminal of said counter whenever the count in said counter is not full.

* * * * *